US009458394B2

(12) United States Patent
Dean et al.

(10) Patent No.: US 9,458,394 B2
(45) Date of Patent: Oct. 4, 2016

(54) FLUIDIZED CATALYTIC CRACKING OF PARAFFINIC NAPHTHA IN A DOWNFLOW REACTOR

(75) Inventors: Christopher F. Dean, Houston, TX (US); Allan Birkett Fox, Dhahran (SA); Daniel C. Longstaff, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 13/560,570

(22) Filed: Jul. 27, 2012

(65) Prior Publication Data

US 2013/0137909 A1 May 30, 2013

Related U.S. Application Data

(60) Provisional application No. 61/512,167, filed on Jul. 27, 2011.

(51) Int. Cl.

| | |
|---|---|
| ***C10G 35/04*** | (2006.01) |
| ***C10G 35/06*** | (2006.01) |
| ***C10G 35/10*** | (2006.01) |
| ***C10G 11/18*** | (2006.01) |

(52) U.S. Cl.

CPC ..... *C10G 35/04* (2013.01); *C10G 11/18* (2013.01); *C10G 11/182* (2013.01); *C10G 2300/104* (2013.01); *C10G 2300/1044* (2013.01); *C10G 2300/301* (2013.01); *C10G 2300/4093* (2013.01); *C10G 2300/708* (2013.01); *C10G 2400/02* (2013.01); *C10G 2400/20* (2013.01)

(58) Field of Classification Search

CPC ..... C10G 35/04

USPC ..... 585/324

See application file for complete search history.

(56) References Cited

U.S. PATENT DOCUMENTS

| | | | |
|---|---|---|---|
| 3,424,672 | A | 1/1969 | Mitchell |
| 3,542,667 | A | 11/1970 | McMahon et al. |
| 3,617,496 | A | 11/1971 | Bryson et al. |
| 3,776,838 | A | 12/1973 | Youngblood |
| 3,784,463 | A | 1/1974 | Reynolds et al. |
| 3,856,659 | A | 12/1974 | Owen |
| 3,928,172 | A | 12/1975 | Davis, Jr. et al. |

(Continued)

FOREIGN PATENT DOCUMENTS

| | | |
|---|---|---|
| EP | 0142900 A2 | 5/1985 |
| EP | 2022838 A1 * | 2/2009 |

(Continued)

OTHER PUBLICATIONS

Barker et al., Kirk-Othmer Encyclopedia of Chemical Technology, 2005, John Wiley and Sons, Inc., pp. 1-42.*

(Continued)

*Primary Examiner* — In Suk Bullock
*Assistant Examiner* — Youngsul Jeong
(74) *Attorney, Agent, or Firm* — Abelman, Frayne & Schwab

(57) ABSTRACT

A process for producing a product stream consisting primarily of the lower olefins ethylene, propylene and butylenes, and of gasoline is provided. The process includes cracking a mixture of paraffinic naphtha feedstream and regenerated catalyst in a downflow reactor. The reaction product stream is separated from the spent catalyst and subsequently fractionated into individual product streams, while the spent catalyst is regenerated and recycled.

23 Claims, 2 Drawing Sheets

(56) References Cited

U.S. PATENT DOCUMENTS

| | | | | |
|---|---|---|---|---|
| 4,051,013 | A | 9/1977 | Strother | |
| 4,066,531 | A * | 1/1978 | Owen et al. | 208/120.1 |
| 4,090,949 | A | 5/1978 | Owen et al. | |
| 4,097,363 | A | 6/1978 | McKinney et al. | |
| 4,116,814 | A | 9/1978 | Zahner | |
| 4,297,203 | A | 10/1981 | Ford et al. | |
| 4,310,489 | A | 1/1982 | Fahrig et al. | |
| 4,385,985 | A | 5/1983 | Gross et al. | |
| 4,693,808 | A | 9/1987 | Dewitz | |
| 4,814,067 | A | 3/1989 | Gartside et al. | |
| 4,830,728 | A | 5/1989 | Herbst et al. | |
| 5,026,935 | A | 6/1991 | Leyshon et al. | |
| 5,026,936 | A | 6/1991 | Leyshon et al. | |
| 5,049,360 | A | 9/1991 | Harandi et al. | |
| 5,053,204 | A | 10/1991 | Herbst et al. | |
| 5,167,795 | A | 12/1992 | Gartside | |
| 5,314,610 | A | 5/1994 | Gartside | |
| 5,344,554 | A | 9/1994 | Pontier et al. | |
| 5,372,704 | A | 12/1994 | Harandi et al. | |
| 5,449,496 | A | 9/1995 | Pontier et al. | |
| 5,582,712 | A | 12/1996 | Zinke et al. | |
| 5,584,986 | A | 12/1996 | Bartholic | |
| 5,730,859 | A | 3/1998 | Johnson et al. | |
| 5,846,403 | A | 12/1998 | Swan et al. | |
| 5,904,837 | A | 5/1999 | Fujiyama | |
| 5,951,850 | A | 9/1999 | Ino et al. | |
| 5,965,012 | A | 10/1999 | Lomas | |
| 6,045,690 | A | 4/2000 | Fujiyama | |
| 6,099,720 | A | 8/2000 | Pontier et al. | |
| 6,146,597 | A | 11/2000 | Nishida | |
| 6,183,699 | B1 | 2/2001 | Lomas | |
| 6,187,272 | B1 | 2/2001 | Ikeda | |
| 6,616,899 | B1 | 9/2003 | Upson | |
| 6,641,715 | B1 | 11/2003 | Gauthier | |
| 6,656,346 | B2 | 12/2003 | Ino et al. | |
| 6,837,989 | B2 | 1/2005 | Stuntz et al. | |
| 6,866,771 | B2 | 3/2005 | Lomas et al. | |
| 6,867,341 | B1 | 3/2005 | Abrevaya et al. | |
| 7,128,827 | B2 | 10/2006 | Tallman et al. | |
| 7,220,351 | B1 * | 5/2007 | Pontier et al. | 208/113 |
| 7,682,500 | B2 * | 3/2010 | Kalnes | 208/89 |
| 2002/0096452 | A1 | 7/2002 | Espeillac et al. | |
| 2002/0195373 | A1 | 12/2002 | Ino et al. | |
| 2004/0004025 | A1 | 1/2004 | Xu et al. | |
| 2004/0110629 | A1 * | 6/2004 | Stamires et al. | 502/60 |
| 2004/0124124 | A1 | 7/2004 | Pinho et al. | |
| 2005/0167333 | A1 | 8/2005 | McCall et al. | |
| 2008/0011645 | A1 | 1/2008 | Dean | |
| 2008/0149534 | A1 * | 6/2008 | Gauthier et al. | 208/309 |

FOREIGN PATENT DOCUMENTS

| | | | |
|---|---|---|---|
| WO | 0144409 | A1 | 6/2001 |
| WO | 2006020547 | A1 | 2/2006 |

OTHER PUBLICATIONS

US-ATSDR, Toxicological profile for gasoline, US Agency for Toxic Substances and Disease Registry, Jun. 1995.*

Al-Tayyar, H. Mohammad, et al., "Development of Novel Refinery Process: From Laboratory Experiments to Commericial Applications," Saudi Aramco Journal of Technology, Spring 2008, pp. 2-9.

Bulatov, R.M., et al., "FCC Process of Heavy Feed Stock with Improved Yield of Light Olefins," Oil and Gas Buisness, 2009, pp. 1-10.

Corma, Avelino, et al., "Different Process Schemes for Converting Light Straight Run and Fluid Catalytic Cracking Napthas in a FCC Unit for Maxiumum Propylene Production," Applied Catalysis 265 (2004), pp. 195-206.

Fujiyama, Yuichiro, et al., "Development of High-Severity FCC Process: An Overview," Studies in Surface Science and Catalysis, vol. 166, 2007, pp. 1-12 (Abstract Only).

Fujiyama, Yuichiro, et al., "Demonstration Plant for New FCC Technology Yields Incresed Propylene," Oil & Gas Journal, Sep. 26, 2005, pp. 54-58.

Niccum, Phillip K., et al., "Future Refinery—FCC's Role in Refinery/Petrochemical Integration," NPRA Meeting (2001), pp. 1-12.

Pinho, Andrea, et al., "Pioneering FCC Process in Down-Flow for Light Olefins," Presented during Scope 2004 Conference, Florence, Italy, Jun. 21-23, 2004, pp. 1-9.

Royo, C., et al., "Kinetics of Catalyst Regeneration by Coke Combustion. I. Increased Reaction Rate Due to the Presence of Chromium," React. Kinet. Catal. Lett., vol. 44, No. 2, 1991, pp. 445-450.

Royo, C., et al., "Kinetics of Catalyst Regeneration by Coke Combustion. II. Influence of Temperature Rise in the Catalyst Particles," React. Kinet. Catal. Lett., vol. 44, No. 2, 1991, pp. 279-285.

Yatsuzuka, Masaki, et al., "Development of HS-FCC (High-severity FCC) Process," 2000 International 5 Petroleum Energy Center, 2000, pp. 1-5.

PCT/US2012/048612, International Search Report and Written Opinion dated Dec. 3, 2012, 10 pages.

Soni et al., "Catalytic cracking process enhances production of olefins," Petroleum Technology Quarterly, 4th Quarter 2009, pp. 95-100.

Corma et al., "Light Cracked Naphtha Processing: Controlling Chemistry for Maximum Propylene Production," Catalysis Today, vols. 107-108, Oct. 30, 2005, pp. 699-706.

Wang et al., "Study of Cracking FCC Naphtha in a Secondary Riser of the FCC Unit for Maximum Propylene Production," Fuel Processing Technology, vol. 89, Issue 9, Sep. 2008, pp. 864-873.

* cited by examiner

FLUIDIZED CATALYTIC CRACKING OF PARAFFINIC NAPHTHA IN A DOWNFLOW REACTOR

RELATED APPLICATIONS

This application claims the benefit of U.S. Provisional Patent Application No. 61/512,167 filed Jul. 27, 2011, the disclosure of which is hereby incorporated by reference in its entirety.

BACKGROUND OF THE INVENTION

1. Field of the Invention

The present invention relates to a process for the catalytic cracking of paraffinic feed streams to optimize the production of lower olefins and particularly the production of propylene.

2. Description of Related Art

Historically, light straight run naphtha (LSRN) from crude processing units was cracked in a fluidized catalytic cracking (FCC) unit. Heavy naphthas were used as reformer feedstocks to produce aromatic gasoline, a process that is still in practice today. Amorphous catalysts and dense phase cracking were part of FCC operations. The LSRN was converted into gases, gasoline and coke. Conversion of LSRN was in the range of 30% to 50%, depending upon the operating conditions. Currently, over 99% of all existing FCC units are based on riser cracking processes, which are typically ineffective for cracking of paraffinic naphtha streams.

Catalytic cracking of olefinic naphthas is well known and is currently practiced in all types of FCC units. Recycled cracked naphtha and olefinic naphthas from FCC units, visbreakers or cokers are easily converted to propylene in the FCC reactor riser with the base feedstock. In this process, the gasoline produced from recycling is high in octane and aromatics.

However, none of the current commercial FCC processes can crack LSRN efficiently and effectively to produce an increased proportion of the lower olefins and gasoline. As used herein, "lower olefins" means ethylene, propylene and butylenes.

It would therefore be desirable to provide a process in which a paraffinic naphtha feed stream is cracked to provide a light olefin product stream, and particularly one having a high propylene content. The paraffinic naphtha feed streams can be derived from a crude oil atmospheric distillation unit, or toppers, that are by-product streams from the recovery of natural gas, or from hydrotreater and hydrocracker units, or other high paraffinic naphtha streams from an extraction process, or from any other refinery or petrochemical process.

SUMMARY OF THE INVENTION

It is therefore an object of the present invention to provide a process in which a paraffinic naphtha feedstream is cracked to produce a high proportion of the lower olefins ethylene, propylene and butylenes, and gasoline.

The process described herein broadly comprehends a fluidized catalytic cracking process that converts paraffinic naphthas having specified characteristics into the lighter olefins, i.e., ethylene, propylene and butylenes, and aromatic gasoline employing a fluidized catalyst in a stand-alone downflow reaction zone utilizing a catalyst or catalyst system from a dedicated catalyst regenerator with a catalyst-to-oil ratio of from 25:1 to 80:1 by weight.

In the process described herein for producing a product stream consisting primarily of the lower olefins ethylene, propylene and butylenes, and of gasoline in a downflow reactor, the feedstream is limited to one containing at least about 40% of paraffinic naphtha or a feedstream containing a minimum of 60% by weight of combined paraffinic and naphthenic compounds. The feedstream used in the process described herein should contain no more than 10% olefin compounds, and preferably less. As the olefin content in the feedstream increases, the conversion of paraffin compounds decreases, resulting in less than optimal yields of the lower olefins in the recovered reaction product stream.

As used herein, the terms "paraffinic naphtha" and "paraffinic naphtha feedstream" include hydrocarbon feedstreams boiling in the range of pentane ($C_5$) hydrocarbons up to about 232° C. (450° F.) and that contains from about 40 to 80 wt % of saturated paraffinic components with less than about 10 wt % olefin components. "Paraffinic naphtha" also includes a combined feed containing paraffinic naphtha and naphthenic compounds.

The paraffinic naphtha feedstreams useful in the process described herein are characterized by a high content of paraffinic compounds, which can include light, medium and heavy paraffinic naphthas. They can be derived from crude oil by distillation, as by-products from the recovery of natural gas, from hydrotreating, hydrocracking and naphtha reforming processes, or from other boiling range naphthas from other refinery or petrochemical facilities. They can also include naphthas from synthetic fuels, such as naphtha from Fischer-Tropsch conversion, or naphthas derived from unconventional oil originating from coal, oil sands, shale oil or thermal pyrolysis.

"Full range naphtha" as used herein refers to a fraction of hydrocarbons in petroleum boiling between 30° C. (86° F.) and 200° C. (392° F.). Light naphtha is the fraction boiling between 30° C. (86° F.) and 90° C. (194° F.) and consists of molecules with 5-6 carbon atoms. Heavy naphtha boils between 90° C. (194° F.) and 200° C. (392° F.) consisting of molecules with 6-12 carbon atoms. The paraffinic naphtha feedstream is comprised principally of saturated paraffin compounds and the remaining components can be naphthenes, aromatics and olefins, in descending order of composition, preferably with the olefins constituting less than 10% by weight of the total stream.

A paraffinic naphtha feedstream suitable for use in the present process can be derived from crude or other atmospheric fractionation columns, and the extraction process of natural gas. It can also be derived from other processes which produce paraffinic-containing hydrocarbons. For example, hydrotreating, hydrocracking and extraction processes utilized in the refining and petrochemical art produce paraffinic hydrocarbons from olefinic and aromatic type feedstreams are suitable for use in the present process. Paraffinic naphtha-containing gas condensates resulting from the production of natural gas and boiling in the naphtha temperature range are suitable for use in the present process.

In general, lighter density naphthas have a greater percentage of paraffinic compounds. Feedstocks that contain greater than about 40 wt % paraffinic hydrocarbons, but with a boiling range higher than about 315° C. (599° F.) and which are not considered a heavy oil in the art are suitable for use as a feedstock in the present process.

Condensates are by-products of natural gas production which are lighter in composition than typical crude oils. A condensate from the production of natural gas or other light distillates, such as kerosene or light diesel which is heavier than the paraffinic naphtha boiling range, but that contains a high percentage of paraffinic compounds are suitable for use as a feedstock in the present process.

Condensates or light crudes that contain 40% to 100% by weight of naphtha-boiling range materials with less than 20% by weight of heavy ends are suitable for use as feedstocks in the present process.

A typical whole condensate can consist of about 50% naphtha, with the other 50% consisting mainly of kerosene and diesel boiling up through 315° C. (599° F.). A feedstock with a boiling point greater than about 370° C. (398° F.) with only trace amounts of some contaminants, such as metalloporphyrins and asphaltenes, can also be utilized. As will be understood by those of ordinary skill in the art, the contaminants are considered to be catalyst poisons and can also produce undesirable chemical reactions.

The process described herein includes the steps of:

a. introducing a paraffinic naphtha feedstream (including a combined paraffinic naphtha and naphthenic feedstream as defined above) into the upper portion of a downflow reactor;
b. introducing regenerated catalyst into the downflow reactor and mixing it with the paraffinic naphtha feedstream in a ratio of catalyst-to-feedstream in the range of from about 25:1 to 80:1 by weight;
c. passing the catalyst and feedstream mixture through a reaction zone in the downflow reactor that is maintained at a temperature in the range of from about 480° C. (896° F.) to 700° C. (292° F.) for a residence time of from about 0.1 to 5 seconds to crack the paraffinic naphtha;
d. separating the reaction product stream containing lower olefins and gasoline from spent catalyst;
e. recovering the reaction product stream; and
f. passing the spent catalyst from the downflow reactor to a dedicated regeneration vessel for regeneration and recycling to the downflow reactor.

BRIEF DESCRIPTION OF THE DRAWINGS

The present process will be described in further detail below and with reference to the attached drawings in which the same or similar reference number is used to refer to the same and similar elements, and in which.

DETAILED DESCRIPTION OF THE INVENTION

The processes and systems described herein are effective for fluid catalytic cracking of a paraffinic naphtha feedstream (including a combined paraffinic naphtha and naphthenic feedstream as defined above). The paraffinic naphtha feedstream is introduced into the upper portion of a downflow reactor along with regenerated catalyst in a ratio of catalyst-to-feedstream in the range from about 25:1 to 80:1 by weight. The catalyst and feedstream mixture is passed through a reaction zone in the downflow reactor that is maintained at a temperature in the range of from about 480° C. (896° F.) to 700° C. (1,292° F.) for a residence time of from about 0.1 second to 5 seconds to crack the feedstream. The reaction products containing lower olefins and gasoline are separated from spent catalyst and recovered. The spent catalyst is passed from the downflow reactor to a dedicated regeneration vessel for regeneration and recycling to the downflow reactor.

In the interest of clarity, the numerous valves, temperature sensors, electronic process controllers and the like that are customarily employed, and that are well known to those of ordinary skill in the art of fluid catalyst cracking, are not included in the attached schematic illustration. Accessory systems that are utilized in conventional FCC systems such as, for example, air supply, catalyst hoppers and flue gas handling and heat recovery are also not shown. Similarly, fresh and spent catalyst hoppers that are provided for storage of make-up and used/equilibrium catalyst that can be added to, or removed from the regenerator, are not shown.

Figure 1:
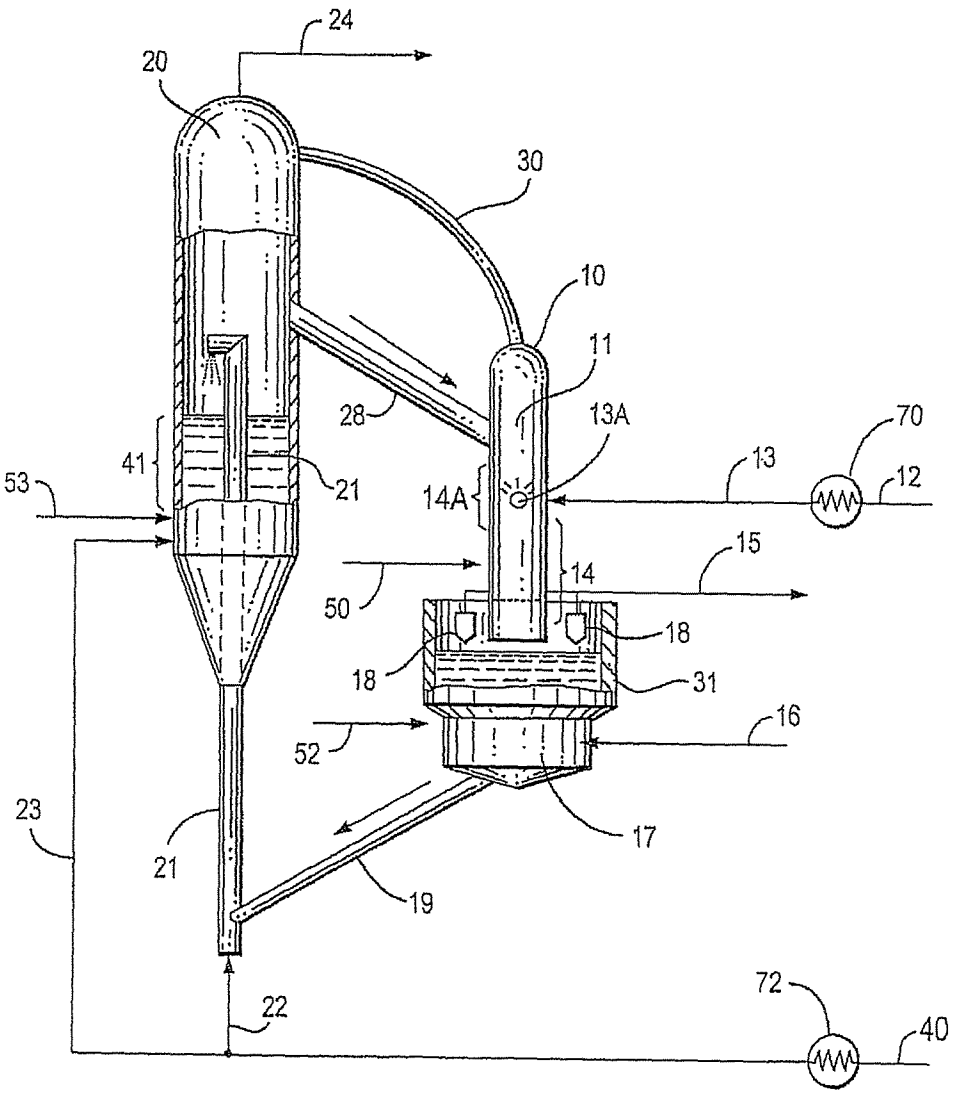
FIG. 1 is a schematic illustration of an embodiment of apparatus for catalytic cracking of a paraffinic naphtha feedstream or a combined paraffinic naphtha and naphthenic feedstream.

Referring to FIG. 1, a system is schematically illustrated including a downflow catalytic cracking reactor 10 and a dedicated catalyst regeneration unit 20. In the practice of the herein method described, hot regenerated catalyst is conveyed via transfer line 28 and is introduced into an upper portion of reactor 10. Feedline 13 introduces a hot paraffinic naphtha feedstream 12 from a preheating vessel 70 that heats the paraffinic naphtha feed for mixing with the incoming regenerated catalyst from regeneration unit 20. Preheating vessel 70 raises the temperature of the feed in a heat exchanger, e.g., using superheated steam as a heat source, to a temperature of about 150° C. (302° F.) to 315° C. (599° F.), to vaporize all or a substantial portion of the feed, which is introduced through a plurality of injection nozzles 13A. The mixture of vaporized paraffinic naphtha and catalyst passes into a reaction zone 14 maintained at a temperature of from about 480° C. (896° F.) to 705° C. (1,301° F.). The ratio of the catalyst-to-naphtha is generally in the range of from about 25:1 to 80:1 by weight and in certain embodiments from about 30:1 to 50:1. The residence time of the mixture in the reaction zone is from about 0.1 to 5 seconds and in certain embodiments from about 0.2 to 2 seconds.

The light reaction product stream containing the lower olefins ethylene, propylene and butylenes, and gasoline, along with any other by-products of cracking reactions, is recovered via reaction product line 15 and withdrawn for further fractionation, product recovery and treating.

Stripping steam is admitted through steamline 16 to drive off relatively easily removable hydrocarbons from the spent catalyst. These gases are discharged from downflow reactor 10 and introduced into the upper portion of stripper vessel 17 where these combined gases pass through one or more cyclone-type separators 18 and out of the stripper vessel via line 15 for reaction product recovery in accordance known processes.

The spent catalyst from downflow reactor 10 is discharged from stripper vessel 17 through transfer line 19 and introduced into the lower end of a diptube 21 (e.g., lift riser), which extends from the lower portion of catalyst regenerator 20. Heated air is introduced below spent catalyst transfer line 19 at the end of diptube 21 via a pressurized air line 22 which has passed through a heat exchanger 72 or other heating device. Further details concerning the operation of downflow reactor 10 are provided herein.

The configuration and selection of materials for the downflow reactor 10 as well as the specific operating characteristics and parameters will be dependent upon the specific qualities and flow rate of the paraffinic naphtha feed, which in turn will be dependent upon the source of the feedstock. Certain operating conditions are set forth below and in the examples.

As noted above, hot regenerated catalyst at about 680° C. (1256° F.) to 815° C. (1499° F.) is transferred from regenerator vessel 20, e.g., through a downwardly directed conduit or pipe 28, commonly referred to as a transfer line, or standpipe, to a withdrawal well or hopper 11 at the top of downflow reactor 10 and above reaction zone 14. The hot catalyst flow is allowed to stabilize in well 11 prior to being introduced into mixing zone or feed injection zone 14A of reaction zone 14. A pressure stabilization line 30 connects the top of downflow reactor 10 to the top of regenerator 20 to facilitate pressure equalization between the two vessels.

The paraffinic naphtha feedstock is injected into mixing zone 14A through a plurality of feed injection nozzles 13A placed in the immediate vicinity of the point of introduction of the regenerated catalyst into downflow reactor 10. Multiple injection nozzles 13A produce a thorough and uniform mixing of the catalyst and oil. When the paraffinic naphtha feedstock contacts the hot catalyst cracking reactions occur. The reaction vapor of hydrocarbon cracked products and unreacted naphtha feed and catalyst mixture quickly flow through the remainder of the downflow reactor reaction zone and into rapid separation zone 31 at the bottom portion of the reactor. Residence time of the mixture in the reaction zone is controlled in accordance with apparatus and procedures known in the art.

In certain embodiments, the cyclone-type separators are constructed and operated in accordance with the description of U.S. Pat. No. 6,146,597, the disclosure of which is incorporated herein by reference in its entirety. An aspect of this type of separator is that the reaction mixture of catalyst and product vapors from the downflow reactor enters an inner cylinder that is sealed on the opposite end with a flat plate. The cylinder's side surface is provided with a plurality of elongated slits extending in the axial direction, spaced equally apart in the circumferential direction and have the same number of curved or flat guide vanes attached. These slits and vanes extend axially and alter the path of the flowing catalyst and vapor mixture and route it to the space defined between the inner and a second outer cylinder. The mixture entering this annular space is forced to flow spirally in the circumferential direction of the inner cylindrical body by the guide vanes and as a result, the solid particles are separated from the vapor by the centrifugal force developed by the spiral flow. The catalyst exits the separator at the bottom and the vapor exits the separator at the top of the outer cylinder.

The reaction temperature, i.e., the outlet temperature of the downflow reactor, is controlled by opening and closing a catalyst slide valve (not shown) that controls the flow of regenerated catalyst from regenerator 20 into withdrawal well 11 and into mixing zone 14A. The heat required for the endothermic cracking reaction is supplied by the regenerated catalyst. By changing the flow rate of the hot regenerated catalyst, the operating severity, or cracking conditions, can be controlled to produce the desired yields of light olefinic hydrocarbons and gasoline.

If necessary for temperature control, a quench injection 50 can be provided for the naphtha feed, recycle cracked naphtha or other light olefinic hydrocarbon near the bottom of the reaction zone 14 immediately before the separator. This quench injection quickly reduces or stops the cracking reactions and can be utilized for controlling cracking severity and provides added process flexibility.

The rapid separation zone 31, along with the end portion of downflow reactor 10 is housed in the upper portion of a large vessel referred to as the catalyst stripper 17. The rapid separator directs the reaction vapor and catalyst directly into the top part stripper vessel 17.

The reactor vapor stream moves upward from the outlet of rapid separator 31 into stripper vessel 17 and combines with stripped hydrocarbon product vapors and stripping gas from the catalyst stripping section of vessel 17 and passes through conventional separating means such as cyclones 18, which further separate any entrained catalyst particles from the vapors. The catalyst from the separator that is removed by the cyclones is directed to the bottom of stripper vessel 17 through a cyclone dipleg (not shown) for discharge into the bed of catalyst that was recovered from the rapid separator in the stripping section.

After the combined vapor stream passes through the cyclones and out of the stripper vessel as the reaction product stream, it is directed through a conduit or pipe commonly referred to as a reactor vapor line 15 to a suitable product recovery system.

Catalyst from the rapid separator and cyclone diplegs flows to the lower section of stripper reactor vessel 17 that includes a catalyst stripping section into which a suitable stripping gas, such as steam, is introduced through steamline 16. The stripping section is provided with several baffles or structured packing (not shown) over which the downwardly flowing catalyst passes counter-currently to the upwardly flowing stripping gas, which can be steam, in order to remove any hydrocarbons that remain in the catalyst pores or between catalyst particles.

The stripped spent catalyst is transported by a portion of the combustion air stream 22 through lift riser 21 that terminates in regenerator 20. The spent catalyst is then contacted by additional combustion air introduced through conduit 23 for controlled combustion of the accumulated coke. The flue gases are removed from the regenerator via conduit 24. In the regenerator, the heat produced from the combustion of the by-product coke is transferred to the catalyst to raise its temperature to that required to provide heat for the endothermic cracking reaction in reactor vessel 10.

In certain embodiments of a method for operating regenerator 20, coke that has formed on the catalyst in the cracking process is burned in a dense phase bed 41 and catalytic activity is restored prior to its recirculation to downflow reactor 10. The heat produced in regenerating the catalyst is thereby transferred from the regenerator to the downflow reactor by the regenerated catalyst. This hot catalyst mixes with the naphtha in the feed injection section at the inlet to the downflow reactor injection zone. This hot catalyst transfers the heat required for vaporizing the paraffinic naphtha and initiating the cracking reactions in the downwardly flowing reaction zone to crack the paraffinic naphtha as described above.

In the cracking of the paraffinic naphtha feedstream, the overall unit operational efficiency is adversely affected by the limited amount of coke produced during the cracking reactions. The amount of coke produced is not sufficient when combusted in regenerator 20 to heat the catalyst to the temperature required by the paraffinic naphtha cracking reactions in the downflow reactor, and to attain the desired regeneration temperature of from about 660° C. (1220° F.) to 815° C. (1499° F.).

The addition of fuel is therefore required in certain embodiments of the process described herein in order to complete the heat balance of the combined reactor and regeneration system. Fuel referred to as stripper torch oil is added to the catalyst in stripping zone 17 through a nozzle at the end of stripper fuel line 52. This fuel is absorbed by the stripped spent catalyst and is later combusted in regenerator 20 to raise the temperature of the catalyst. In order to ensure sufficient combustion and heat generation within the catalyst bed, fuel referred to as regenerator torch oil is also injected into the dense bed through a nozzle at the end of regenerator fuel line 53 and is consumed to provide additional heat to the catalyst.

The stripper torch oil and regenerator torch oil fuels can be from the same or different sources. Suitable fuels are lean oils or light hydrocarbon oils such as naphthas, kerosene, diesel, furnace oil, pyrolysis oil, or other by-product streams from a refinery or petrochemical facility and that contains minimal solid fine material such as catalyst, iron scale or coke and minimal catalyst contaminants that might poison and deactivate the catalyst such as nickel, vanadium, sodium, calcium, and the like.

Fuel gas, or liquefied petroleum gas (LPG) which contains primarily butanes and propane can also be used to supplement the regenerator torch oil in regenerator 20. The cracked naphtha by-products can also be used as all or a portion of the fuel required in the process.

An air heater 72 is provided for start-up and, as needed, for continuous use to heat the air up to about 650° C. (1202° F.) to provide additional heat to the catalyst for regeneration and meet the overall process heat balance. The fuel provided to the air heater can be fuel gas or LPG. An air compressor (not shown) supplies the air via line 40 to air heater 72 for start-up and continuous operation for supplying hot air to the catalyst lift riser and for regeneration.

The catalyst or catalyst systems that can be used in the process described herein are not limited. In certain embodiments suitable catalyst components are zeolites and matrixes. The suitable zeolites for use in FCC processes are types Y, H-EY, USY, and RE-USY. In certain embodiments a suitable shape-selective catalyst used in the FCC process to produce lower olefins and increase gasoline octane is ZSM-5 zeolite crystal and other pentasil type catalyst structure. This pentasil structure can be in a catalyst particle as one component with other zeolites and matrix components, or as an additive. This ZSM-5 additive can be mixed with other cracking catalyst zeolites and matrix structures and is preferably used in the method described herein to maximize and optimize the paraffinic naphtha cracking in the downflow reactor.

Examples of suitable catalyst components are described in U.S. Pat. Nos. 5,904,837 and 6,045,690, the disclosures of which are incorporated herein by reference. The matrixes include clays such as kaolin, montmorillonite, halloysite and bentonite, and inorganic porous oxides such as alumina, silica, boria, chromia, magnesia, zirconia, titania and silica-alumina, and mixture thereof.

In addition to the ultrastable Y-type zeolite, a catalyst comprising a crystalline aluminosilicate zeolite or silicoaluminophosphate (SAPO), each having smaller pores than the ultrastable Y-type zeolite, can be used. The aluminosilicate zeolites and the SAPOs include ZSM-5, SAPO-5, SAPO-11 and SAPO-34. The zeolite or the SAPO can be included in the catalyst particles containing the ultrastable Y-type zeolite, or can be contained in other catalyst particles.

In addition, other zeolites such as ferrierite and molecular sieves and matrixes of interlaced clays generally known as pillared clays can also be used in the present processes to maximize and optimize the paraffinic naphtha cracking in the downflow reactor.

The catalyst or catalyst system functions in the downward flowing reaction zone to crack the paraffinic naphtha under optimum conditions to produce a high proportion of lower olefins from the naphtha feed, with minimal unwanted by-products of gases and coke.

Figure 2:
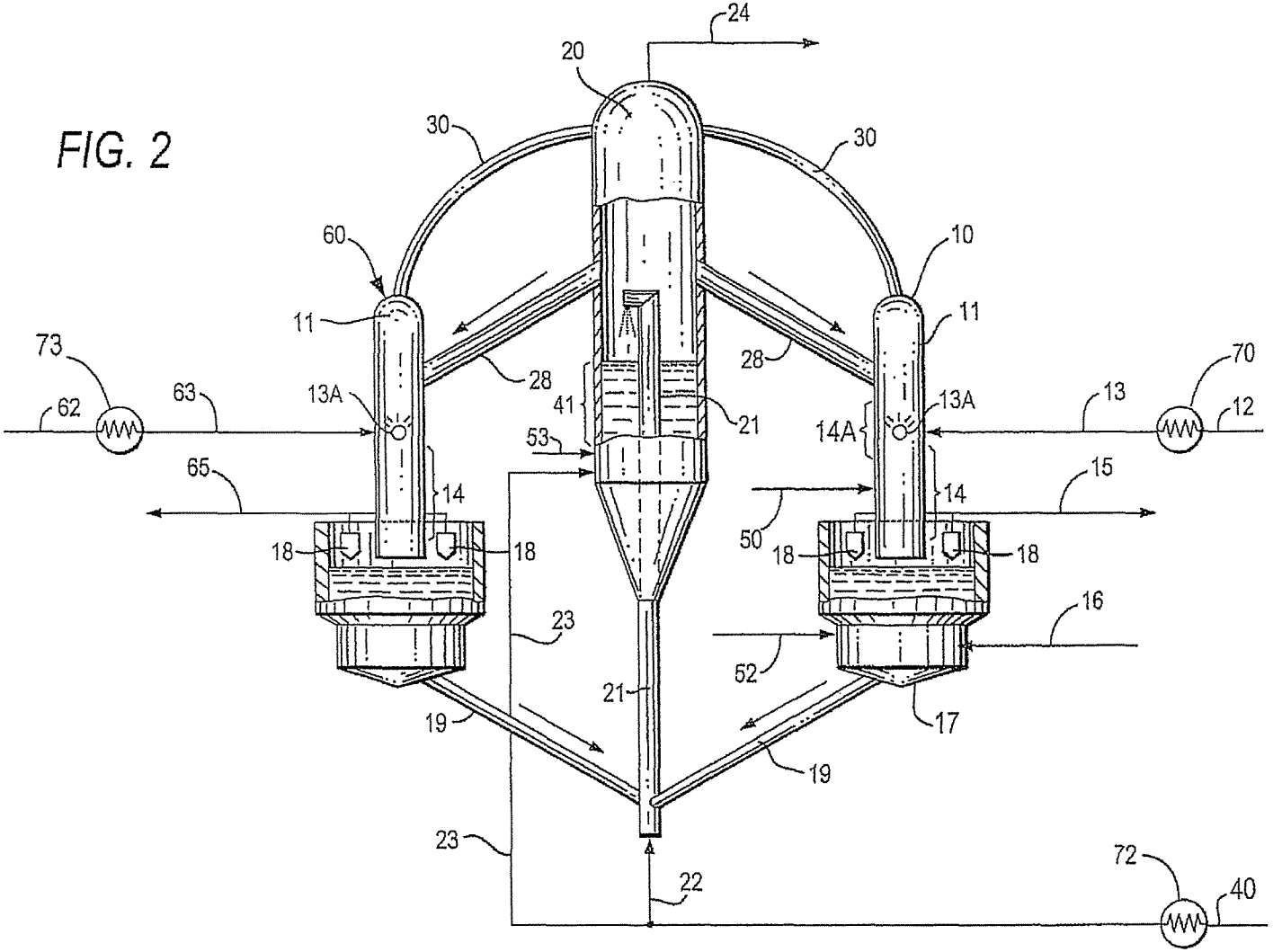
FIG. 2 is a schematic illustration of an additional embodiment of an apparatus suitable for catalytic cracking of a paraffinic naphtha feedstream or a combined paraffinic naphtha and naphthenic feedstream.

FIG. 2 shows a further embodiment in which a reaction product stream recovered from line 15 of the primary downflow reactor is subjected to fractionation (not shown) to recover as separate end product streams the lower olefins, i.e., ethylene, propylene and butylenes, and gasoline. The remaining by-products, consisting of light cycle oil and slurry oil are recovered. Other by-products including hydrogen and methane as dry gases, and the light hydrocarbons ethane, methane, propane and butanes are recovered and used in other refining and petrochemical processes or, alternatively, they can be used as fuel in regenerating the catalyst in the present process.

The gasoline recovered in the fractionator is directed as a recycle stream 62 to an adjacent ancillary downflow reactor 60 to be further cracked to produce additional propylene from the $C_5$, $C_6$ and higher olefinic species produced with the gasoline product from the first downflow reactor 10. Recycle stream 62 is heated in a heat exchanger 73 and the heated recycle stream 63 is charged to the reaction zone 14 of ancillary downflow reactor 60 to produce a reaction stream 65 containing additional propylene which is recovered by fractionation (not shown).

This second or ancillary downflow reactor 60 is constructed and functions in a manner similar to downflow reactor 10 described with respect to FIG. 1, with the exception that its feed is the olefinic gasoline product recycle stream 62. In addition, any olefinic gasoline product stream from existing refinery or petrochemical processes can be used to supplement the feedstock to ancillary downflow recycle reactor 60.

The flexibility of the process described herein also permits the use of heavier feedstreams that are more dense than the light paraffinic naphthas preferred for use within the operational parameters of the present process; however, as will be understood by one of ordinary skill in the art, the production yields of the desired lower olefins will be less than the yield obtained from a paraffinic naphtha feedstream.

Downflow reactors utilize gravity to decrease residence times in the reaction zone and can circulate higher quantities of hot regenerated catalyst as compared to riser type reactors, thereby permitting higher catalyst-to-oil ratios. These high catalyst-to-oil ratios of hot regenerated catalyst result in better conversion of the paraffinic naphtha feedstock with better selectivity or higher product yields to lighter olefins than can be obtained utilizing riser reactors.

Downflow reactors have additional advantages due to the length of the reactor cracking zone compared to existing FCC riser reactor zones, which are more than double or triple the length utilized in downflow reactors suitable for the processes described herein. Therefore, the design of FCC riser reactors is determined principally based on catalyst circulation and mechanical requirements rather than reaction kinetics for cracking paraffinic naphtha feedstreams as in the Present processes.

The paraffinic naphtha feedstream utilized in the process described herein contains a high level of saturated compounds and a low olefins content. Paraffinic naphtha produced by non-cracking refining and petrochemical processes can also contain olefins. In order to effectively and efficiently catalytically crack naphtha paraffins in accordance with the present processes, olefin content of the feedstream is minimized as those olefins compete for the active catalyst cracking sites at the detriment of the paraffins.

EXAMPLE

A bench scale pilot plant unit in the configuration of FIG. 1 was operated under cracking conditions in the downflow reactor for two different paraffinic naphtha feedstocks that are representative of typical feedstreams that are suitable for use in the process described herein. The results obtained were used in a simulation model to develop the operating conditions for the full-scale downflow reactor unit.

Table 1 lists the properties and product yields from cracking two naphtha streams, thus exhibiting the cracking potential of paraffinic naphtha for production of light olefins. The full range naphtha (FRN) stream included the typical components present in the boiling range from $C_5$ to about 230° C. (446° F.). The light cut naphtha (LCN) stream is a lighter subset of the FRN as indicated by the 50% and 95% lower boiling points.

The catalyst used in the examples was a typical low rare earth, low hydrogen transfer, USY zeolite cracking catalyst blended with a shape-selective ZSM-5 zeolite type cracking catalyst additive that are both commercially available.

TABLE 1

| Feed Stock Type | Light Cut Naphtha | | Full Range Naphtha | |
|---|---|---|---|---|
| Typical Properties | | | | |
| Density gm/cc | 0.666 | | 0.722 | |
| Distillation | | | | |
| Vol. % | ° C. / ° F. | | ° C. / ° F. | |
| IBP | 32 | 90 | 45 | 113 |
| 10% | 44 | 111 | 73 | 163 |
| 30% | 49 | 120 | 88 | 190 |
| 50% | 56 | 133 | 102 | 216 |
| 70% | 66 | 151 | 121 | 250 |
| 90% | 82 | 180 | 153 | 307 |
| 95% | 89 | 192 | 176 | 349 |
| PONA's Vol. % | | | | |
| Paraffins | 81 | | 63 | |
| Olefins | 0 | | 0 | |
| Naphthenes | 13 | | 28 | |
| Aromatics | 2 | | 9 | |
| Operating Conditions | | | | |
| Catalyst Type | USY + ZSM-5 | | | |
| Temperature ° C. (° F.) | 650 (1202) | | | |
| Product Yields, wt. % | | | | |
| Ethylene | 10.9 | | 10.4 | |
| Propylene | 21.1 | | 18.0 | |
| Butylenes | 8.6 | | 8.3 | |
| Dry Gas ($H_2$ + $C_1$) | 3.6 | | 3.2 | |
| Ethane | 4.58 | | 3.3 | |
| Propane | 7.6 | | 8.0 | |
| Butanes | 6.3 | | 9.2 | |
| Gasoline | 37.0 | | 39.2 | |
| Conversion to lighter hydrocarbons wt. % | 63.0 | | 60.8 | |

As shown in the Table above, the propylene yield was 21.1 wt % for the LCN and 18 wt % for the FRN at the same reactor temperature. The conversion to propylene is higher for the LCN due to the lighter feedstock components. The higher gasoline yield from the FRN is due to a lower conversion rate of the higher content of heavier aromatics that are relatively harder to crack as compared to the components in the LCN. The data from these tests show that both LCN and FRN are excellent feedstocks for producing a high proportion of propylene.

The invention has been described above and in the drawings with reference to certain presently preferred embodiments and it will be understood that various modifications and changes can be made by those of ordinary skill in the art based upon this description, and the scope of the invention is therefore to be determined by the claims that follow.

The invention claimed is:

1. A method of enhancing the conversion of a major proportion of a paraffinic naphtha feedstream into lighter hydrocarbon reaction products that include a high proportion of the lower olefins comprising ethylene, propylene and butylenes, and gasoline, the method comprising:

a. introducing a feedstream containing a minimum of 40% by weight of paraffinic naphtha boiling in the range of from 30° C. (86° F.) to 200° C. (392° F.) and containing less than 10% by weight of olefin components, or a feedstream containing a minimum of 60% by weight of combined paraffinic naphtha and naphthenic compounds and containing less than 10% by weight of olefin components into the top of a downflow reactor and mixing it with catalyst;

b. operating the downflow reactor with a residence time of 0.1 seconds to 5 seconds of the mixture of the feedstream and catalyst in a reaction zone at an operating temperature in the range of 480° C. (896° F.) to 700° C. (1292° F.) and with a catalyst-to-feedstream ratio in the range of from 25:1 to 80:1 by weight to produce a reaction product stream that includes the lower olefins comprising ethylene, propylene and butylenes, and gasoline;

c. separating the reaction product stream produced in the downflow reactor from spent catalyst in a stripper zone downstream of the reaction zone;

d. recovering the reaction product stream from the stripper zone;

e. passing spent catalyst from the stripper zone to a regeneration vessel for regeneration with a supplemental source of heat to increase the temperature in the regeneration vessel thereby producing a regenerated catalyst, the regeneration vessel receiving spent catalyst only from the downflow reactor; and f. recycling the regenerated catalyst to the top of the downflow reactor.

2. The method of claim 1, wherein the paraffinic naphtha feedstream is subjected to preheating to a temperature in the range of from 150° C. (302° F.) to 315° C. (599° F.) prior to its introduction into the reaction zone.

3. The method of claim 2 in which the feedstream is preheated in a heat exchanger or a furnace.

4. The method of claim 1, wherein the residence time in the reaction zone is in the range of from 0.2 seconds to 2 seconds.

5. The method of claim 1 in which the downflow reactor is operated continuously.

6. The method of claim 1 in which the reaction product stream is separated from the spent catalyst in a cyclonic separation apparatus.

7. The method of claim 1, further comprising applying a quenching fluid to the reaction product stream and the catalyst at a location downstream of the reaction zone.

8. The method of claim 1, further comprising stripping the spent catalyst downstream of the reaction zone with steam.

9. The method of claim 1, wherein the regeneration vessel includes a catalyst lift riser into which heated combustion air is passed to support combustion and provide lift.

10. The method of claim 9 in which the regeneration vessel includes a dense phase bed to which additional heated combustion air is added.

11. The method of claim 1 in which the quantity of coke formed on the spent catalyst is insufficient to raise the temperature of the regenerated catalyst exiting the regeneration vessel to the operating temperature range; and the method further comprises adding a liquid fuel to the catalyst in the stripper zone.

12. The method of claim 10 in which the regeneration vessel includes a dense phase bed, and the method further comprises introducing a liquid fuel and/or fuel gas as the supplemental heat source into the dense phase bed and burning the fuel to thereby raise the temperature of the regenerated catalyst.

13. A method of enhancing the conversion of a major proportion of a paraffinic naphtha feedstream into lighter hydrocarbon reaction products that include a high proportion of the lower olefins comprising ethylene, propylene and butylenes, and gasoline, the method comprising:

a. introducing a first feedstream containing a minimum of 40% by weight of paraffinic naphtha boiling in the range of from 30° C. (86° F.) to 200° C. (392° F.) and containing less than 10% by weight of olefin components, or a first feedstream containing a minimum of 60% by weight of combined paraffinic naphtha and naphthenic compounds and containing less than 10% by weight of olefin components into the top of a downflow reactor and mixing it with catalyst;

b. operating the downflow reactor with a residence time of 0.1 seconds to 5 seconds of the mixture of the feedstream and catalyst in a first reaction zone at an operating temperature in the range of 480° C. (896° F.) to 700° C. (292° F.) and with a catalyst-to-feedstream ratio in the range of from 25:1 to 80:1 by weight to produce a first reaction product stream that includes the lower olefins comprising ethylene, propylene and butylenes, and gasoline;

c. separating the first reaction product stream produced in the downflow reactor from spent catalyst in a first stripper zone downstream of the first reaction zone;

d. recovering the first reaction product stream from the first stripper zone;

e. directing a second feedstream comprising at least a portion of the gasoline contained in the first reaction product stream into an ancillary downflow reactor;

f. operating the ancillary downflow reactor with a residence time of 0.1 seconds to 5 seconds of the mixture of the second feedstream and catalyst in a second reaction zone at an operating temperature in the range of 480° C. (896° F.) to 700° C. (1292° F.) and with a catalyst-to-feedstream ratio in the range of from 25:1 to 80:1 by weight to produce a second reaction product stream that includes the lower olefins comprising ethylene, propylene and butylenes, and gasoline g. separating the second reaction product stream produced in the ancillary downflow reactor from spent catalyst in a second stripper zone downstream of the second reaction zone;

h. passing spent catalyst from the first and second stripper zones to a regeneration vessel for regeneration with a supplemental source of heat to increase the temperature in the regeneration vessel thereby producing a regenerated catalyst, the regeneration vessel receiving spent catalyst from the first and second stripper zones; and i. recycling the regenerated catalyst to the top of the downflow reactor and the top of the ancillary reactor.

14. The method of claim 13, wherein the residence time in the first reaction zone or the second reaction zone is in the range of from 0.2 seconds to 2 seconds.

15. The method of claim 14 in which the first feedstream to the downflow reactor or the second feedstream to the ancillary downflow reactor is preheated in a heat exchanger or a furnace.

16. The method of claim 13 in which the downflow reactor or the ancillary downflow reactor is operated continuously.

17. The method of claim 13 in which the first reaction product stream or the second reaction product stream is separated from the spent catalyst in a cyclonic separation apparatus.

18. The method of claim 13, further comprising applying a quenching fluid to the first reaction product stream and its catalyst at a location downstream of the first reaction zone or to the second reaction product stream and its catalyst at a location downstream of the second reaction zone.

19. The method of claim 13, further comprising stripping the spent catalyst downstream of the first reaction zone or the second reaction zone with steam.

20. The method of claim 13, wherein the regeneration vessel includes a catalyst lift riser into which heated combustion air is passed to support combustion and provide lift.

21. The method of claim 20 in which the regeneration vessel includes a dense phase bed to which additional heated combustion air is added.

22. The method of claim 13 in which the quantity of coke formed on the spent catalyst is insufficient to raise the temperature of the regenerated catalyst exiting the regeneration vessel to the operating temperature range, and the method further comprises adding a liquid fuel to the catalyst in the stripper zone.

23. The method of claim 21 in which the regeneration vessel includes a dense phase bed, and the method further comprises introducing a liquid fuel and/or fuel gas as the supplemental heat source into the dense phase bed and burning the liquid fuel and/or fuel gas to thereby raise the temperature of the regenerated catalyst.

* * * * *